United States Patent [19]

Caddock

[11] Patent Number: 4,866,411

[45] Date of Patent: Sep. 12, 1989

[54] FILM-TYPE CYLINDRICAL RESISTOR, AND METHOD OF MAKING IT

[76] Inventor: Richard E. Caddock, 1793 Chicago Ave., Riverside, Calif. 92507

[21] Appl. No.: 173,723

[22] Filed: Mar. 25, 1988

[51] Int. Cl.[4] ..... H01C 3/02

[52] U.S. Cl. ..... 338/62; 29/610.1

[58] Field of Search ..... 338/62, 61, 286, 292; 29/610.1

[56] References Cited

U.S. PATENT DOCUMENTS

| | | | |
|---|---|---|---|
| 3,858,147 | 12/1974 | Caddock | 338/62 |
| 3,880,609 | 4/1975 | Caddock | 29/620 |
| 3,881,162 | 4/1975 | Caddock | 338/61 |
| 3,921,119 | 11/1975 | Caddock | 338/217 |
| 4,075,968 | 2/1978 | Caddock | 118/7 |
| 4,132,971 | 1/1979 | Caddock, Jr. | 338/61 |
| 4,697,335 | 10/1987 | Pedersen et al. | 29/620 |

FOREIGN PATENT DOCUMENTS

| | | | |
|---|---|---|---|
| 1314388 | 4/1973 | United Kingdom | 17/00 |

OTHER PUBLICATIONS

Electro-Science Laboratories, Inc., Bulletin #42479, "Protective Coating #240-5B".

Electro-Science Laboratories, Inc., Bulletin, "Polymer Protective Coatings 242-5, 242-5B, 242-D", E. I. Du-Pont de Nemours & Co., Electric Materials Division.

Bulletin, "Du Pont Thick Film Dielectric Compositions, 5137 and 9137 Application".

*Primary Examiner*—H. Broome

*Assistant Examiner*—M. M. Lateef

*Attorney, Agent, or Firm*—Richard L. Gausewitz

[57] ABSTRACT

A film-type cylindrical resistor in which the end caps fit over the environmentally protective coating. Both the resistive film and the environmentally protective coating are applied by screen printing. Termination films are provided at the ends of the resistive film, and are electrically contacted by the end caps. The method comprises screen printing the resistive and termination films, and the environmental coating, and then mounting the end caps by interference-fit connections.

33 Claims, 2 Drawing Sheets

FILM-TYPE CYLINDRICAL RESISTOR, AND METHOD OF MAKING IT

BACKGROUND OF THE INVENTION

In U.S. Pat. No. 3,858,147, there is shown and described a non-inductive film-type cylindrical resistor in which the resistive film material is applied by silk-screen printing (hereinafter called "screen printing"). This is done very efficiently and economically, as by using the screen-printing apparatus of U.S. Pat. No. 3,880,609.

The efficiency and economy that characterize application of the resistive film material have not, during manufacture of large numbers of such cylindrical resistors over a period of many years, been mirrored in certain other major aspects of the manufacturing operation. These major aspects include application of the environmentally protective dielectric coating such as is shown in U.S. Pat. No. 3,858,417 at reference numeral 28; they further include the final straightening, cleaning, and dressing of the leads that extend axially from the end caps.

It is conventional, in the manufacture of cylindrical film-type resistors, to complete all aspects of the manufacturing operation except application (and curing) of the environmentally protective coating, and then to apply such coating over the entire resistor, including its end caps. There is thus encapsulation of the entire resistor. Only the leads project.

The coating material employed for the above-indicated encapsulation is necessarily at low viscosity. Therefore, as soon as the coating material is applied, by dipping, the resistor is put on a fixture that rotates the resistor about its longitudinal axis Rotation is continued until the coating material dries As the result of the rotation, the coating material does not sag, and it is relatively uniform in thickness. Curing of the encapsulating coating is then effected, at high temperature.

A single coating of environmentally protective material, that has been applied in the above-stated manner, is generally not adequate Accordingly, one or more additional coatings are applied. Each dipping operation is followed by rotation in the fixture, and this is followed by a high-temperature cure.

The lead wires that project axially from the end caps are affected so substantially, by the repeated high-temperature cures, that it is conventional to gold plate them. The gold plating eliminates or reduces the harm done to the lead wires by the repeated cures. However, gold plating is an expensive step vis-a-vis material especially.

The lead wires are repeatedly handled during the various process steps indicated above, and which have been employed for years. Typically, therefore, leads become bent. They also become partially covered by environmentally protective material It follows that final steps in the conventional process for manufacturing the cylindrical resistors include tedious hand dressing, cleaning and straightening operations performed on the lead wires. It is to be understood that, for cosmetic and other reasons important to customers, the leads of the resistors should be straight, clean, and coaxial with the end caps.

The above descriptive material relates primarily to process difficulties, and attendant increased costs, with regard to conventional cylindrical film-type resistors. There is, however, another problem that is not fully process related but also relates to a characteristic of the finished resistor. This problem is present when the resistor is potted with other components in an electronic package, as often occurs. When the end caps are precovered with environmentally protective coatings, there are two interfaces in the potted electronic package. One interface is between each end cap and its coating. The other interface is between such coating and the potting material. Especially since the coating and potting materials have different dielectric constants, the presence of two interfaces is a disadvantage in circuit applications.

SUMMARY OF THE INVENTION

Applicant has now discovered that cylindrical film-type resistors that are highly satisfactory for many applications can have screen-printed environmentally protective coatings, and bare end caps. This is to be contrasted with cylindrical resistors having dip-applied encapsulating coatings that cover the end caps.

Stated otherwise, the present invention goes contrary to encapsulation such as has been conventional for decades. Instead of encapsulation, there is screen printing of an environmentally protective substance onto only the cylindrical substrate and the conductive films thereon, but not including termination film portions. The end caps are not screen printed.

The screen-printed coatings do not require rotating in a fixture (or otherwise) for a drying step, since their rheology (viscosity and thixotropy) are such that no rotation is needed. Also, a single-layer screen-printed coating is more environmentally protective than is a single-layer coating applied by dipping.

The end caps are applied as the last step in the manufacturing operation. Thus, they are not exposed to any firing steps. The leads are not bent, nor are they partially (or wholly) covered by environmental protective material. It follows that no gold plating, straightening, cleaning, or dressing is needed. The bare end caps are more satisfactory in typical potted electronics packages than are coated end caps.

In accordance with the method, a resistive film is first applied to a cylindrical substrate, and is then fired. The resistive film is subsequently trimmed to the exact desired resistance value. Termination film material is applied to the end portions of the resistive film. A screen-printed environmentally protective coating is applied over the resistive film, and is then cured. Finally, cylindrical end caps having leads extended axially therefrom are press fit over the ends of the substrate, and are caused to be in effective contact with the termination film material.

The article has a resistive film, covered by a screen-printed dielecrtric coatinging, and further has end caps that are electrically connected to the resistive film. The end caps are not covered by the screen-printed dielectric coating.

In the preferred form of the method and article, the resistive film is screen printed onto the cylindrical substrate, and has a serpentine pattern. There is a gap, extending longitudinally of the substrate, between the corner portions of the serpentine line. The environmentally protective coating is screen printed over the serpentine resistive pattern, and also has a longitudinal gap therein Such latter gap is caused to register with the gap in the serpentine pattern The cylindrical end caps are press fit over the cylindrical substrate sufficiently far that the inner surfaces thereof engage not only the termination film material but also the environmentally protective coating.

Figure 5:
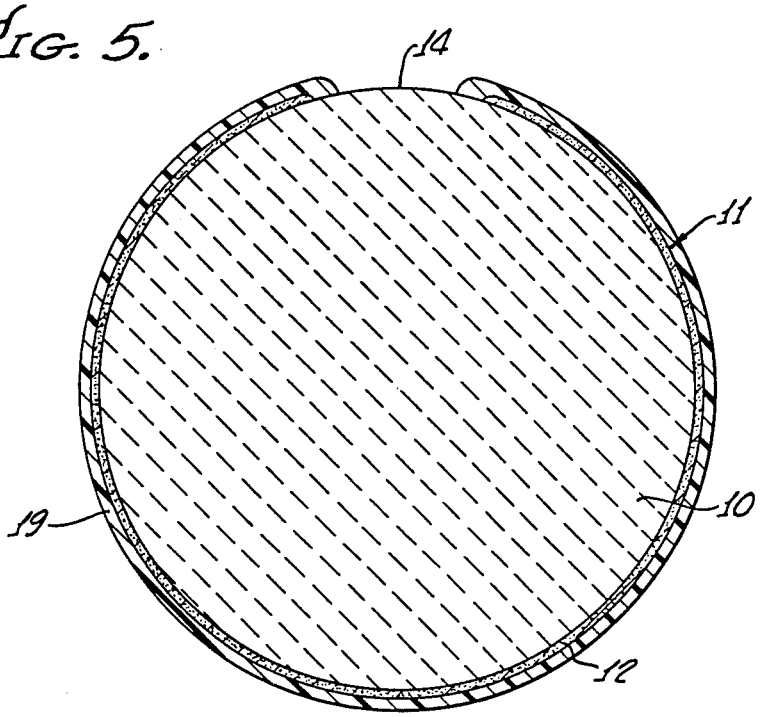
FIG. 5 is a greatly enlarged transverse sectional view on line 5—5 of FIG. 1.
Figure 6:
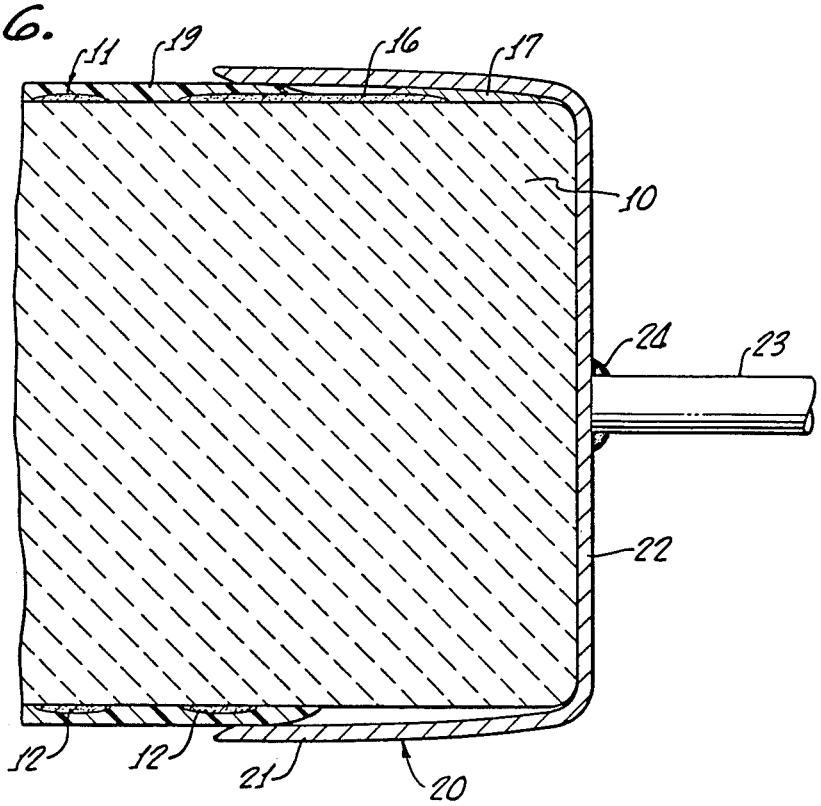
FIG. 6 is a greatly enlarged fragmentary longitudinal sectional view on line 6—6 of FIG. 1.

The thicknesses (and diameters) of the elements shown in FIGS. 5 and 6 are not to scale. For example, the thickness of the resistive film has, in such figures, been exaggerated—relative to the substrate diameter—for clarity of illustration.

DETAILED DESCRIPTION OF THE PREFERRED METHOD AND ARTICLE

Figure 2:
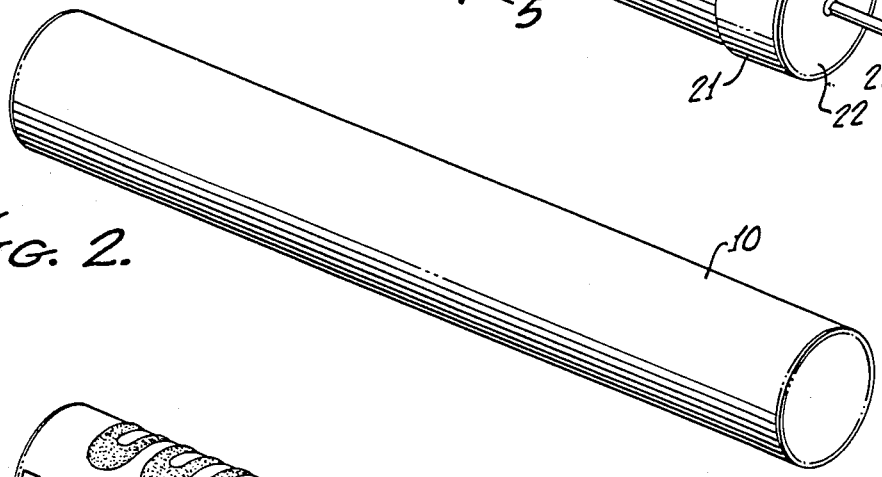
FIG. 2 is an isometric view of the cylindrical substrate.

Referring first to FIG. 2, there is illustrated a typical cylindrical substrate 10. The cylinder 10 is heat resistant, is preferably formed of a ceramic, and is preferably solid instead of hollow The substrate 10 may have numerous lengths and diameters as desired for particular circuit applications, the sizes ranging from quite large to tiny "toothpick" sizes.

Figure 3:
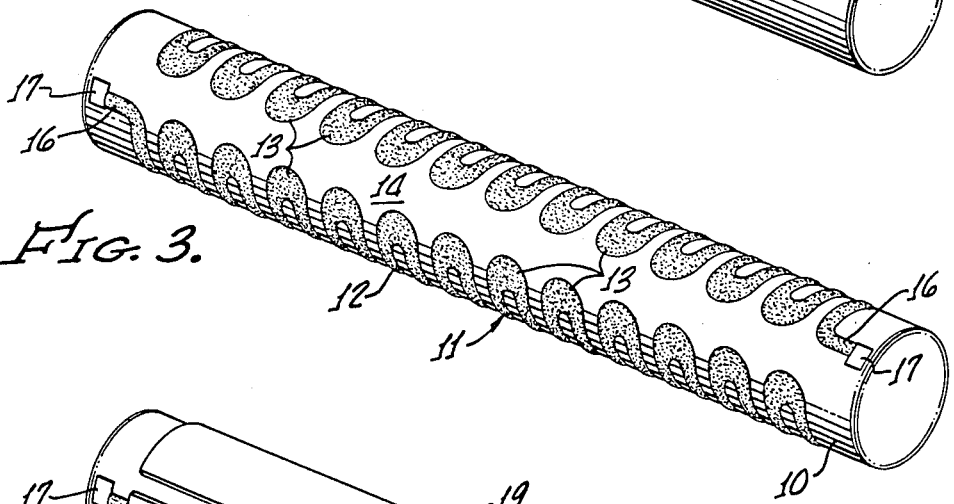
FIG. 3 is an isometric view showing the non-inductive serpentine screen-printed resistive film on the cylindrical substrate, and also showing termination films at the ends of the resistive film.

Referring next to FIG. 3, a resistive film 11 is applied to the exterior cylindrical surface of cylinder 10

Preferably, resistive film 11 is spaced—except for connector portions—from both ends of the substrate. Preferably, film 11 is one created by screen printing since this results in what is known in the art as a "thick film" and, furthermore, since the thickness of the film is uniform and it can be very closely controlled. The resistive film may also be what is known in the art as a "thin film", for example, one applied by vapor deposition of a resistive metal.

Preferably, resistive film 11 is directly screen printed onto substrate 10 by a suitable screen printing apparatus. One such apparatus is described in U.S. Pat. No. 4,075,968 for Apparatus for Manufacturing Cylindrical Resistors by ThickFilm Silk-Screening.

Preferably, the resistive film 11 is in the form of a long strip or line 12 having a serpentine pattern or configuration, With adjacent portions of the serpentine strip being sufficiently close together to effect inductance cancellation. Such adjacent portions of the serpentine strip may be termed "arms". The arms are preferably parallel to each other, and each extends circumferentially about the exterior of substrate 10 in a plane perpendicular to the axis of such substrate.

The above-indicated arms of the serpentine strip connect to each other at bend or base portions 13. The bend or base portions are, in the preferred configuration, disposed in two parallel rows extending longitudinally of substrate 10 at opposite sides of a gap 14 in the resistive film 11. The gap 14 also extends longitudinally of the substrate.

In the preferred form, the bends 13 are relatively wide, being substantially wider than are the parallel arm portions of strip 12. The relatively wide bends 13 minimize the chance that there will be circuit discontinuities when the resistor is trimmed by lapping.

After the resistive film 11 has been applied, the substrate 10 with film 11 thereon is fired as described in U.S. Pat. No. 3,858,147. After the firing, the screen printed thick-film strip or line 12 has a feathered configuration when viewed in cross-section, reference being made to the left portion of FIG. 6 of the present patent application.

For a more detailed description of the method and apparatus relative to the preferred screen printed thick-film resistor, and a method and apparatus for making it, reference is made to U.S. Pat. Nos. 3,858,147, 3,880,609, 4,075,968, and 4,132,971. The disclosures of all of said patents are hereby incorporated by reference herein.

The longitudinal gap 14 between the parallel rows of bends 13 preferably extends for the full length of substrate 10. In the present resistor, the width of such gap 14, that is to say the dimension of the gap circumferentially of the substrate, is preferably somewhat greater than the minimum width of gap specified in certain of the above-cited patents. This is to make it more practical to apply to substrate 10 a screen-printed layer of environmentally protective coating having a gap somewhat narrower than gap 14.

At each end of the serpentine pattern, there is a tail or connector portion 16 of strip 12, reference being made to the left and right ends of FIG. 3. After the resistive film has been fired, there is applied over each tail 16 a film 17 that is highly conductive as distinguished from resistive. Conductive films 17 may be applied in various ways. They may, for example, be manually applied by means of a brush. They may also be applied by a screen printing operation, or by dipping the ends of the resistor in a pool of the conductive material. The films 17 shown in FIG. 3 are quite small, but they may extend over much larger regions, including most or all the way around the substrate as shown and described relative to reference numerals 23 and 24 in U.S. Pat. No. 3,858,147. After application of the films 17, the resistor is again fired. The conductive films 17 minimize contact-resistance problems, providing better connections between the resistive film 11 and the end caps described below.

The resistive film 11 is then adjusted, vis-a-vis resistance value, so that its resistance is as desired. This is preferably done by lapping as described in U.S. Pat. No. 4,132,971 cited above.

Figure 4:
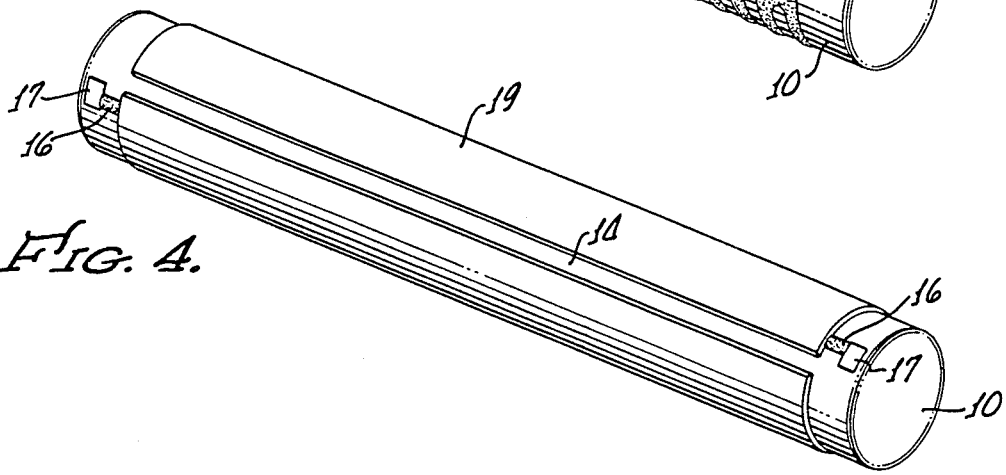
FIG. 4 shows the resistor after a screen-printed environmentally protective coating has been applied over the resistive film but not over the termination films.

Referring next to FIGS. 4–5, a screen printed environmentally protective coating 19, of dielectric (insulating) substance, is applied over the resistive film 11 but not over conductive films 17. Very preferably, coating 19 is applied by direct silk screening thereof onto the cylinder 10 over resistive film 11, though not necessarily over those portions of tails 16 that are near films 17. Application may be by suitable screen printing apparatus, for example, the one shown and described in U.S. Pat. No. 4,075,968.

As shown in FIG. 5, the screen printed environmental coating 19 preferably covers a portion of the gap 14 between the opposed rows of bends 13. Stated otherwise, the screen printing operation which applies environmental coating 19 is so conducted that there is a longitudinal gap that is registered with gap 14, and that is preferably somewhat narrower than gap 14 in order to ensure that the portions of bends 13 immediately adjacent gap 14 will be covered by the environmental coating 19. The above relationship is accomplished by making the permeable area of the screen employed to deposit coating 19 somewhat longer (in the direction of screen movement) than is the permeable area of the screen employed to deposit resistive film 11.

Coating 19 is preferably rectangular in shape in a developed view (not shown). Stated otherwise, the permeable region of the screen that is used to screen print coating 19 is preferably rectangular in shape.

The resistor is then heated or fired in order to cure the environmentally protective coating 19. The amount of heating, the duration of heating, etc., depend upon the particular coating 19 employed.

Although a single-layer coating 19 normally has protective and dielectric properties superior to those of a single layer of silicone conformal (the material conventionally employed for encapsulation of entire cylindrical resistors), it is within the scope of the present invention to provide one or more additional layers of environmentally protective coating 19. After application of each layer, by screen printing, heating or firing is effected to cure the layer as required by the particular substance employed.

It is presently preferred that only one layer 19 of environmentally protective substance be provided.

There is no requirement that the resistors be rotated about their longitudinal axes prior to or during curing, because the coating substances have such rheologies (viscosities and thixotropies) that the coatings do not sag or flow after screen printing has been performed.

Figure 1:
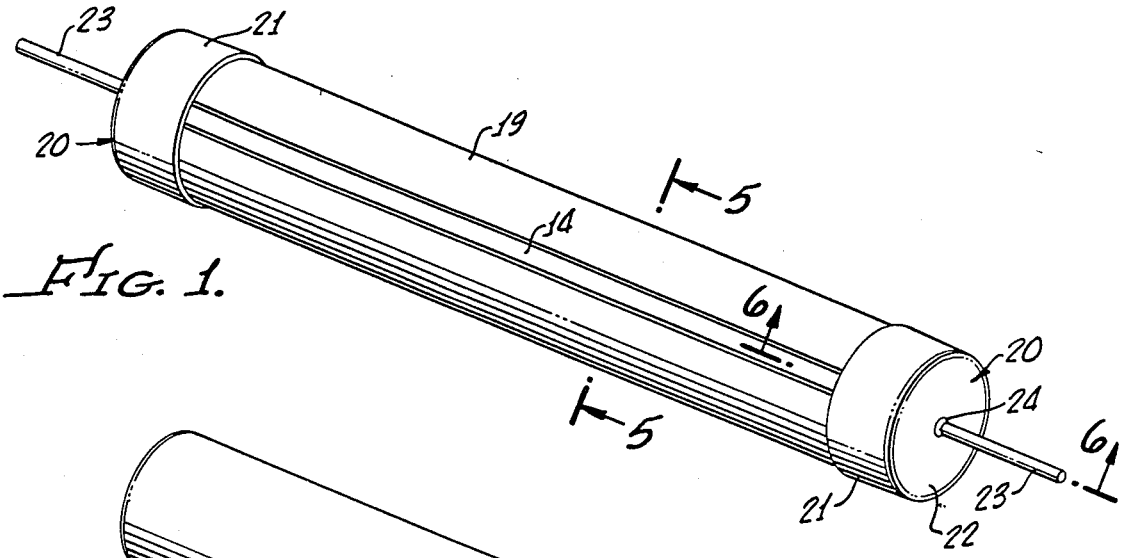
FIG. 1 is an isometric view of a finished resistor incorporating the present invention.

As the final step in the method, end caps 20 are press-fit over the ends of cylinder 10, so as to be in physical and electrical contact with conductive films 17. The end caps are preferably cylindrical and cup-shaped, as illustrated. Very preferably, the end regions of protective coating 19 are sufficiently close to the ends of substrate 10, and the end caps are sufficiently- deep, that the rim regions of the end caps telescope over the coating 19 as best illustrated in FIGS. 1 and 6.

The relationships are caused to be such that the interior cylindrical surface of each end cap 20 is in effective contact with a conductive layer 17 while, at the same time, rim regions of the end caps are telescoped over and in contact with the screen-printed coating 19.

It is emphasized that screen printing permits the thickness of the coating 19 to be very accurately controlled. Furthermore, the end caps 20 are preferably formed by stamping (more specifically, deep drawing followed by shearing), so that their interior dimensions are also effectively controlled. The thicknesses of the coatings 17 and 19, and the dimensions of the interior surfaces of end caps 20, are selected in order to create effective interference fits between the end caps and not only the conductive films 17 but also the dielectric environmentally protective coating 19.

Each end cap 20 is a highly conductive hollow cylinder 21 preferably formed of a metal, and preferably having a bottom wall 22 that is adjacent the end of substrate 10. Projecting from the bottom wall 22 is a lead 23 that is preferably caused to be coaxial with the end cap 20 and thus with the substrate 10. Each lead 23 is welded to the center of wall 22 by a weld 24 (FIG. 6). The welding is effected prior to the pressing of the end caps 20 onto the ends of the substrate, and is such that the lead extends perpendicular to the bottom wall 22 as shown.

As indicated in FIG. 6, the interior surfaces of the end caps 20 at the rim regions thereof are beveled (divergent in directions away from the ends of the substrate) somewhat. This facilitates pressing of the end caps onto the substrate ends.

The pressing of the end caps 20 onto the substrate is done carefully, by a suitable pressing tool that permits leads 23 to continue their axially-projecting relationship during all stages of the pressing operation. Thus, the leads 23 are not bent or adversely affected by the pressing. Since the application of the end caps is the final step in the method, it follows that there is no need to straighten any leads 23, or to remove any material from such leads by cleaning and hand dressing operations. Also, it is not necessary that the leads 23 be gold plated in order to prevent damage thereto during firing operations.

The environmentally protective coating 19 is formed of a "screen printable" dielectric (insulating) material. One such material that has been employed by applicant in performing the method of the present invention, and creating the article of the present invention, is a resin-type mineral-filled silicone. More specifically, such material is number 240-SB described in bulletin number 42479, by Electro-Science Laboratories, Inc. of Pennsauken, N.J.

Another screen printable material that has been employed by applicant in the present invention is number 242-SB by said Electro-Science Laboratories, Inc. Such latter material is a mineral-filled epoxy, and is described in a bulletin promulgated by said Electro-Science Laboratories, Inc. and entitled POLYMER PROTECTIVE COATINGS 242-S, 242-SB, 242-D, the bulletin being numbered 22084.

A further screen printable substance that has been employed by applicant in the present invention is number 9137, produced by E.I. Du Pont de Nemours & Co. Electronic Materials Division of Wilmington, Del. This is described in a Du Pont bulletin entitled "Du Pont Thick Film Dielectric Compositions 5137 and 9137".

The Du Pont screen printable material is a vitrifying glass frit. It is heated to a peak temperature of about 500° C., this being in contrast with the above-indicated Electro-Science materials that are only heated to temperatures of about 150° C. When a resistor is fired at a high temperature, such as 500° C., its resistance value changes somewhat. Thus, when the Du Pont material is employed, trimming is effected after application of the dielectric screen-printed coating.

A further screen printable substance that may be employed is a resin-type polyimide. It may be obtained as EPO-TEK 600BLT from Epoxy Technology, Inc. of Billerica, Mass. It also cures at 150° C.

As a specific example, which is given by way of illustration and not limitation, the substrate 10 is a centerless-ground cylinder of aluminum oxide, having a diameter of 0.250 inch. The resistive film 11 is composed of electrically conductive complex metal oxides in a glass matrix, and has a thickness of 0.0007 inch. The environmentally protective coating 19 is the above-specified resin-type mineral-filled silicone, and has a thickness of 0.0015 inch. Each end cap 20 is formed of stainless steel, and has a wall thickness of 0.010 inch. The inner diameter of cylinder 21 is 0.246 inch plus or minus 0.002 inch. The conductive coating 17 is a silver-ceramic conductive material in a glass matrix, and has a thickness of 0.001 inch at regions that contact the exterior cylindrical surface of substrate 10.

The present article is of high quality, yet may be manufactured by the present method at relatively low cost and with a high rate of production.

The two bulletins identified above and promulgated by Electro-Science Laboratories, Inc., and the above-identified bulletin by Du Pont, are hereby incorporated by reference herein as though set forth in full.

The foregoing detailed description is to be clearly understood as given by way of illustration and example only, the spirit and scope of this invention being limited solely by the appended claims.

I claim:

1. A film-type resistor, which comprises:
(a) a cylindrical substrate,
(b) a film of resistive material provided around at least portions of the exterior surface of said substrate and conforming to said surface of said substrate,
(c) a coating of environmentally protective insulating material provided over said resistive film t insulate and environmentally protect the same, and
(d) electrically conductive end caps provided on opposite ends of said substrate and being electrically connected with said resistive film, characterized in that said coating (c) does not extend over said end caps (d).

2. The invention as claimed in claim 1, in which said end caps are in interference-fit engagement with said substrate.

3. The invention as claimed in claim in which said end caps have cylindrical sidewalls and generally radial bottom walls, and in which leads are connected to said bottom walls.

4. A cylindrical film-type resistor, which comprises:
(a) a cylindrical substrate,
(b) a resistive film adherently applied to the exterior cylindrical surface of said substrate,
(c) highly conductive termination films adherently applied over said resistive film at regions respectively near the ends of said substrate,
(d) conductive end caps fit over the ends of said substrate and over at least portions of said termination films,
said end caps being in contact with said termination films and thus being electrically connected to said resistive film, and
(e) an environmentally protective coating adherently applied to the exterior cylindrical surface of said substrate and overlying said resistive film,
said environmentally protective coating not overlying said end caps.

5. The invention as claimed in claim 4, in which said environmentally protective coating (e) is one which has been formed by screen printing and has a precisely controlled uniform thickness and has a precisely controlled area of application, said area of application not including at least substantial portions of said termination films (c).

6. The invention as claimed in claim 5, in which said environmentally protective coating (e) is one which has been directly screen printed onto said substrate.

7. A film-type cylindrical resistor, which comprises:
(a) a cylindrical substrate,
(b) a film of resistive material adherently provided on the exterior cylindrical surface of said substrate,
(c) a coating of environmentally protective material adherently provided on the exterior cylindrical surface of said substrate over said resistive film,
(d) films of highly conductive termination material adherently provided over said resistive film at predetermined regions relatively adjacent the ends of said substrate, and
(e) electrically conductive end caps mounted on the ends of said substrate and overlying and contacting both:
(1) at least parts of said termination films (d), and
(2) the regions of said environmentally protective coating (c) that are relatively adjacent the ends of said substrate.

8. The invention as claimed in claim 7, in which said end caps are metal cups press fit onto the ends of said substrate, said metal cups being in interference-fit engagement with said termination films (d) and with said environmentally protective coating (c).

9. The invention as claimed in claim 7, in which said coating (c) of environmentally protective material is one that has been formed by screen printing, having a uniform controlled thickness and a controlled area of application.

10. The invention as claimed in claim 9, in which said coating (c) of environmentally protective material is one which is formed of screen printable material, and which has been screen printed directly onto said substrate.

11. The invention as claimed in claim 7, in which said resistive film (b) has a gap therein extending longitudinally of said substrate, and in which said coating (c) of environmentally protective material also has a gap therein extending longitudinally of said substrate, said gaps being substantially registered with each other.

12. The invention as claimed in claim 11, in which said gap in said coating (c) of environmentally protective material is narrower than said gap in said resistive film (b), the relationships between said gaps being such that all regions of said film (b) adjacent said gap therein are covered by said coating (c).

13. The invention as claimed in claim 7, in which said film (b) of resistive material is a non-inductive serpentine film having a gap therein that extends longitudinally- of said substrate, said resistive film having rows of bends at opposite sides of said gap, and in which said coating (c) of environmentally protective material has a gap therein that extends longitudinally of said substrate, said gaps being substantially registered with each other.

14. The invention as claimed in claim 13, in which said coating (c) of environmentally protective material is substantially rectangular in shape when developed.

15. The invention as claimed in claim 13, in which said resistive film (b) is a thick-film resistive film that has been directly screen printed onto said substrate.

16. The invention as claimed in claim 7, in which said film (b) of resistive material is a non-inductive serpentine film having a gap therein that extends longitudinally of said substrate, said film having rows of bends adjacent opposite sides of said gap, said film (b) having been formed by screen printing, and in which said environmentally protective coating (c) is a coating formed by screen printing.

17. The invention as claimed in claim 16, in which said film (b) is a thick-film formed of resistive material that has been directly screen printed onto said substrate, and in which said environmentally protective coating (c) is a coating of screen printable environmentally protective material that has been directly screen printed onto said substrate over said film (b).

18. A cylinder film-type resistor, which comprises:

(a) a cylindrical ceramic substrate,
(b) a noninductive thick-film serpentine film of resistive material adherently provided by screen printing onto the exterior cylindrical surfaces of said substrate,
said film (b) having highly uniform in thickness and having a controlled known thickness,
(c) an environmentally protective coating of screen printable insulating material adherently provided by screen printing onto the exterior cylindrical surface of said substrate over said serpentine resistive film,
said coating (c) being highly uniform in thickness and having a controlled known thickness, and
(d) metal end caps press-fit over the ends of said substrate and over portions of said coating (c),
said end caps having inner substantially cylindrical surfaces the diameters of which are so correlated, to the diameter of said substrate and to film portions thereon, as to create a correct interference-fit relationship therewith, said end caps being in electrical contract with said film of resistive material.

19. The invention as claimed in claim 18, in which highly conductive termination films are provided over said resistive film, and in which portions of said termination films are not covered by said environmentally protective coating and are in direct contract with inner surface portions of said end caps.

20. A method of manufacturing a relatively low-cost high-quality film type cylindrical resistor, said method comprising:
(a) providing a cylindrical substrate,
(b) providing a film of resistive material exteriorly on said substrate,
(c) providing over said resistive material film at least one layer of environmentally protective insulating material, and
(d) providing electrically conductive end caps over opposite ends of said substrate and causing said end caps to be electrically connected with said resistive material,
said end caps being provided after said providing of said environmentally protective insulating material.

21. The invention as claimed in claim 20, in which said method further comprises press-fitting said end caps onto said substrate so as to cause said end caps to be in interference-fit relationship with said substrate.

22. A method of manufacturing a relatively low-cost high-quality film-type cylindrical resistor, said method comprising:
(a) providing a cylindrical substrate,
(b) applying a resistive film to the exterior cylindrical surface of said substrate,
(c) applying conductive termination films over portions of said resistive film adjacent the end portions of said substrate,
(d) screen printing a coating of screen-printable environmentally protective insulating material over said resistive film but not over at least portions of said termination films, and
(c) thereafter press-fitting electrically conductive end caps over the ends of said substrate is such relationships that said end caps are in contact with said portions of said termination films.

23. The invention as claimed in claim 22, in which said method further comprises causing said end caps to be in interference-fit relationship with said termination films and also with portions of said coating of environmentally protective insulating material.

24. The invention as claimed in claim 22, in which said method comprises performing said step (b) by screen printing a thick-film resistive film onto said substrate, in such manner that said resistive film has a gap therein longitudinally of said substrate

25. The invention as claimed in claim 24, in which said method further comprises performing said step (d) in such manner that said insulating coating has a gap therein longitudinally of said substrate, and also in such manner that said last-mentioned gap substantially registers with said gap in said resistive film.

26. The invention as claimed in claim 24, in which said method further comprises causing said thick-film resistive film to be in a serpentine non-inductive pattern, the bends of said pattern being in rows along opposite edges of said gap in said resistive film.

27. The invention as claimed in claim 26, in which said method further comprises causing said end caps to be in interference-fit relationship with said termination films and also with portions of said coating of environmentally protective insulating material.

28. A method of manufacturing a film-type resistor, comprising:
(a) providing a cylindrical substrate formed of heat resistant insulating ceramic,
(b) screen printing a thick-film resistive film onto said substrate,
(c) firing said substrate and said resistive film thereon,
(d) screen printing termination films onto said substrate over end portions of said resistive film, near the ends of said substrate,
(e) screen printing at least one layer of screen printable environmentally protective insulating coating onto said substrate over said resistive film but not over at least portions of said termination films,
(f) heating said substrate to cure said insulating coating, and
(g) thereafter press-fitting cup-shaped metal end caps over the ends of said substrate in such relationships that interior cylindrical surface portions of said end caps are in contact with said termination films.

29. The invention as claimed in claim 8, in which said method further comprises so performing said steps (e) and (g) that interior cylindrical surface portions of said end caps are in interference-fit relationship with said termination films and also with end portions of said environmentally protective insulating coating.

30. The invention as claimed in claim 28, in which said method further comprises employing, as said screen printable environmentally protective insulating coating, a resin-type mineral-filled silicone.

31. The invention as claimed in claim 28, in which said method further comprises employing, as said screen printable environmentally protective insulating coating, a mineral-filled epoxy.

32. The invention as claimed in claim 28, in which said method further comprises employing, as said screen printable environmentally protective insulating coating, a vitrifying glass frit.

33. The invention as claimed in claim 28, in which said method further comprises employing, as said screen printable environmentally protective insulating coating, a resin-type polyimide.

* * * * *

UNITED STATES PATENT AND TRADEMARK OFFICE

CERTIFICATE OF CORRECTION

PATENT NO. : 4,866,411

DATED : September 12, 1989

INVENTOR(S) : Richard E. Caddock

It is certified that error appears in the above-identified patent and that said Letters Patent is hereby corrected as shown below:

Claim 1 (column 7, line 20), delete "t" and substitute therefor ---to---.

Claim 3 (column 7, line 30), after "claim", add ---1,---.

Claim 18 (column 9, line 4), delete "surfaces" and substitute therefor ---surface---.

Claim 29 (column 10, line 46), delete "8" and substitute therefor ---28---.

Signed and Sealed this

Twenty-eighth Day of January, 1992

*Attest:*

HARRY F. MANBECK, JR.

*Attesting Officer*

*Commissioner of Patents and Trademarks*